United States Patent [19]

Kuriyama et al.

[11] Patent Number: 5,045,241

[45] Date of Patent: Sep. 3, 1991

[54] METHOD FOR SOLIDIFYING RADIOACTIVE WASTES

[75] Inventors: Osamu Kuriyama, Hitachi; Kiyomi Funabashi; Tsutomu Baba, both of Katsuta; Masami Matsuda, Hitachi; Koichi Chino, Hitachi; Makoto Kikushi, Hitachi, all of Japan

[73] Assignee: Hitachi, Ltd., Tokyo, Japan

[21] Appl. No.: 330,083

[22] PCT Filed: Jul. 10, 1987

[86] PCT No.: PCT/JP88/00596

§ 371 Date: Mar. 9, 1989

§ 102(e) Date: Mar. 9, 1989

[87] PCT Pub. No.: WO89/00753

PCT Pub. Date: Jan. 26, 1989

[30] Foreign Application Priority Data

Jul. 10, 1987 [JP] Japan ..... 62-171028

[51] Int. Cl.[5] ..... G21F 9/16

[52] U.S. Cl. ..... 252/628; 252/629; 252/633

[58] Field of Search ..... 252/628, 629, 633; 264/0.5; 422/159; 250/506.1, 507.1

[56] References Cited

U.S. PATENT DOCUMENTS

| | | | |
|---|---|---|---|
| 4,139,488 | 2/1979 | Knolik et al. | 252/628 |
| 4,505,851 | 3/1985 | Funabashi et al. | 252/628 |
| 4,581,162 | 4/1986 | Kawamura et al. | 252/628 |
| 4,648,990 | 3/1987 | Uetake et al. | 252/628 |
| 4,717,510 | 1/1988 | James | 252/628 |
| 4,851,155 | 7/1989 | Kanagawa et al. | 252/628 |

*Primary Examiner*—Brooks H. Hunt
*Assistant Examiner*—Ngoclan T. Mai
*Attorney, Agent, or Firm*—Antonelli, Terry, Stout & Kraus

[57] ABSTRACT

A method of solidifying radioactive wastes comprising the steps of substituting the atmosphere inside a container packed with radioactive waste with a condensable vapor, pouring a matrix material into said container and thereafter condensing said vapor. The condensable vapor can be steam and the matrix material can be alkaline organic material.

3 Claims, 8 Drawing Sheets

METHOD FOR SOLIDIFYING RADIOACTIVE WASTES

DESCRIPTION

1. Technical Field

This invention relates to a method and apparatus for solidifying radioactive wastes, and more particularly to a method and apparatus for the solidification processing of non-combustible miscellaneous wastes by use of an inorganic matrix material such as cement.

2. Background Art

Among various radioactive wastes generated from a nuclear power plant, so-called metallic wastes such as used piping arrangement, valves, etc., and non-combustible solid wastes consisting of concrete are stored mostly in the nuclear power plant while they are put into drums at present.

It is the recent trend, however, to conduct solidification treatment of the non-combustible solid wastes, too. It has been a customary practice to solidify the non-combustible solid wastes by cement as the solidification treatment. Since the non-combustible miscellaneous solid wastes are generally great in size and cannot be mixed or kneaded by a mixer, a method has been employed conventionally which first puts the non-combustible miscellaneous solid wastes into a container and then pours the matrix material such as cement into the container. (Refer, for example, to "Research and Development on Processing of Radioactive Wastes", published by Sangyo Kijutsu, Feb. 5, 1983, pp. 63-65). FIG. 2 of the accompanying drawings is a conceptual view (cited from the reference described above) of a solidification apparatus for non-combustible solid wastes that has been employed conventionally. The conventional solidification apparatus for the non-combustible miscellaneous solid wastes includes a free fall pouring system utilizing the difference of heads of height and a pump pressure-feed system utilizing a monotype pump.

FIG. 3 shows schematically the result when miscellaneous solid wastes wrapped by a plastic sheet consisting of an organic polymer compound such as a polyethylene sheet are put into a drum and cement is then poured in accordance with the conventional system. It has been found that voids or spaces are formed at the portions where the cement mortar cannot enter easily such as between the polyethylene sheet 18 and the miscellaneous solid wastes 3 and below the miscellaneous solid wastes 3.

The conventional technique described above does not take into consideration the voids or spaces that occur in a matrix and inside the container when the cement mortar is poured. In other words, since the spaced which will cause a decreased in the strength of the matrix occur in the solidified waste forms, the conventional technique is not suitable for obtaining the waste form for land disposal. Disclosure of Invention:

It is therefore an object of the present invention to provide a method of producing a waste form which is suitable for land disposal and has less voids, and an apparatus for practising this method of producing the waste form.

The object of the invention described above can be accomplished by utilizing the change of a reduced pressure of the pressure in the voids after pouring of a matrix material with respect to the pressure in the spaces at the time of pouring of the matrix material when the matrix material is poured into the spaces defined between radioactive solid wastes or spaces defined between the radioactive solid wastes and a container, in order to pour the matrix material after the radioactive solid wastes are packed into the container. The object of the invention can be accomplished by, for example, charging a gas in advance which reacts with the matrix material and is eventually absorbed in the matrix material into the container for producing the solidified waste form into which the wastes are packed, and then by pouring the matrix material.

Pouring of the matrix material by utilizing the change of the reduced pressure will be explained about the case where a gas which reacts with the matrix material is in advance charged and the matrix material is then poured, by way of example.

Solid wastes such as miscellaneous solid wastes are put into a container for producing a solidified waste form (e.g. a drum) and a gas which reacts with a matrix material and is absorbed in the matrix is charged in advance. Next, the matrix material is poured into the container to produce the solidified waste form. At this time, the active gas exists in the voids occurring in the matrix Therefore, the matrix material and the gas react with each other and establish a reduced pressure state in the voids. The voids which are thus under the reduced pressure state are ruptured by the external pressure of the matrix material and the matrix material which is under the fluidization state fills the voids while dropping. In this manner there can be obtained solidified waste forms which has less voids.

Hereinafter, preferred embodiments of the present invention will be described with reference to the accompanying drawings.

Embodiment 1

Figure 1:
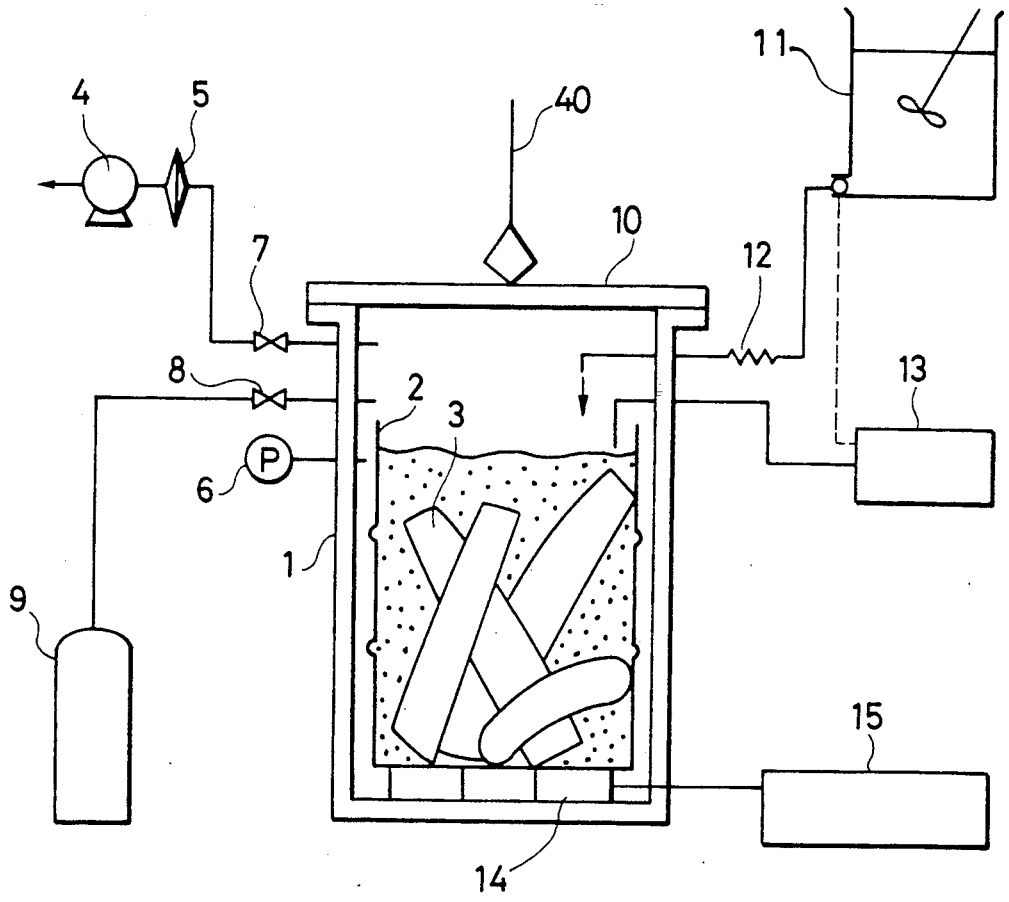
FIG. 1 is a conceptual view of an apparatus in accordance with one embodiment of the present invention.
Figure 2:
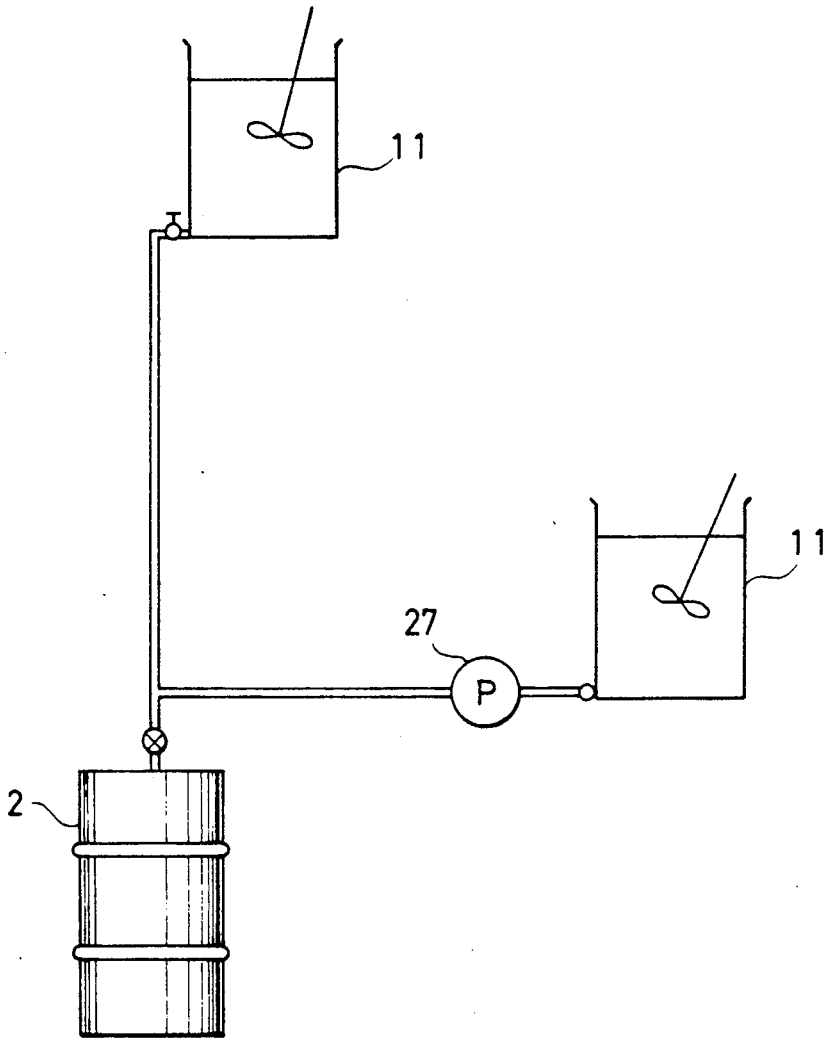
FIG. 2 is a conceptual view of an apparatus in accordance with the prior art example.
Figure 3:
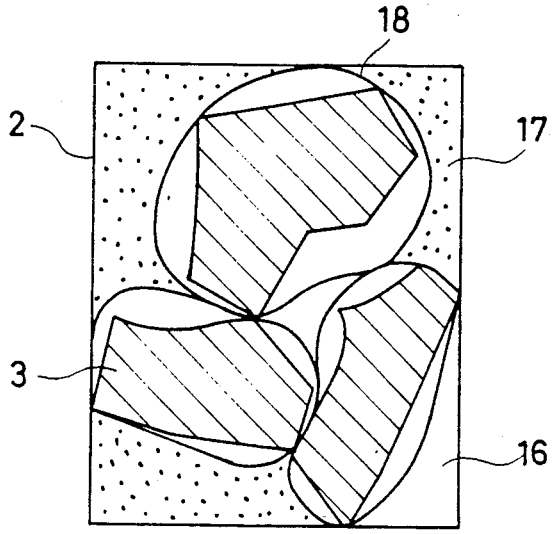
FIG. 3 is a schematic sectional view of a solidified waste form in accordance with the prior art technique.

FIG. 1 is a conceptual view useful for explaining one embodiment of the present invention. This embodiment was directed to a procedure for solidifying with cement non-combustible miscellaneous solid wastes (so-called "metallic wastes" such as used piping arrangements and valves and concrete wastes) which are put into a drum while wrapped by a plastic sheet made of a organic polymer material such as a polyethylene sheet. The non-combustible miscellaneous solid wastes 3 wrapped by ,the polyethylene sheet were put into the drum 2 which was stored in a pressure-resistant container 1. Air inside the pressure-resistant container was evacuated by a vacuum pump 4. Any radioactive substances contained in the air thus evacuated were removed by an HEPA (High Efficiency Particle Air) filter 5. Evacuation was stopped and a valve 7 was closed when a pressure gauge 6 representing the internal pressure of the pressure-resistant container 1 reached 0.05 kg/cm$^2$ or below in terms of absolute pressure.

After a valve 8 was opened, a carbon dioxide gas cylinder 9 was opened and carbon dioxide was charged into the pressure-resistant container 1 until the pressure gauge 6 read 1 kg/cm$^2$ in terms of absolute pressure. After the interior of the pressure-resistant container was substituted by carbon dioxide, a lid 10 of the pressure-resistant container was opened by lift means 40 such as a crane. Cement mortar from a cement mixer 11 was poured into the drum 2. In the interim, a flexible pipe 12 and a monotype pump, whenever necessary, were used to prevent the piping arrangement from being clogged by the cement mortar. The pouring quantity of the cement mortar into the drum was measured by a level meter 13 and controlled on the basis of the detection result of the level meter 13. The quantities of the miscellaneous solid wastes and poured cement mortar were measured by a load cell 14. The data thus obtained was inputted to a management system 15 for evaluating the solidified waste form properties, and management was made by use of the values of both the wastes and cement mortar, that were inputted in advance, whether or not any gaps or voids occurred inside the matrix of the miscellaneous solid wastes in the drum (refer to the later-appearing item (2)).

Figure 4:
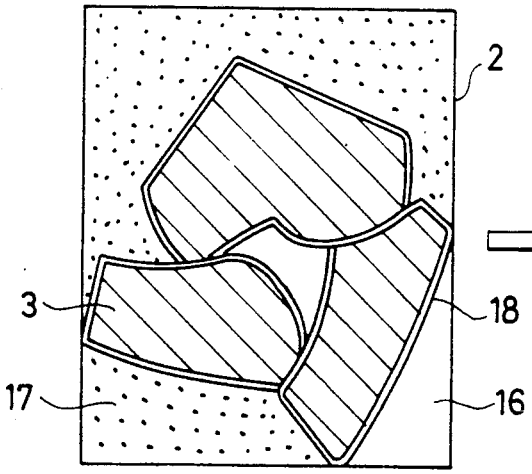
FIGS. 4(*a*) and 4(*b*) are schematic sectional views of the solidified waste form and are useful for explaining the effect of the present invention.
Figure 4:
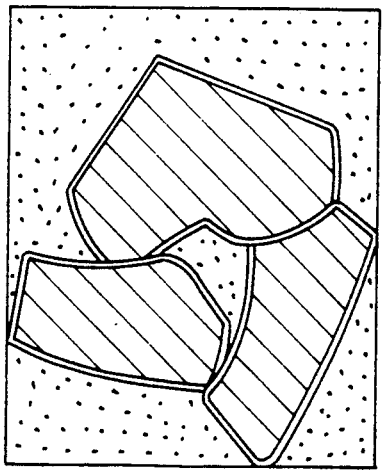

When the carbon dioxide and then the cement mortar were charged into the drum after it was evacuated as described above, the gas volume ratio to the mortar inside the drum was about 1%. FIG. 4 is a schematic view useful for explaining the effect of this embodiment. The left-hand view (a) in FIG. 4 shows the state inside the drum 2 immediately after charging of the cement after evacuation and substitution by the carbon dioxide. The void 16 was observed in the spaces encompassed by the miscellaneous solid wastes 3 and below them. The right-hand view (b) in FIG. 4 is a schematic view after about 30 minutes. The carbon dioxide in the void 16 reacted with the calcium ions or atoms in the cement motar, the matrix material, in accordance with the formula (1) below and was absorbed and solidified in the cement:

$$Ca^{2+}(\text{in cement}) + CO_2 + 2OH^- \rightarrow CaCO_3 + H_2O \quad (1)$$

Therefore, the void 16 entered a reduced pressure state and the cement mortar 17 fell from above and filled the void 16. As a result, the matrix in which hardly any void existed as shown in the right-hand view (b) of FIG. 4 could be obtained. Incidentally, the void volume ratios to the matrix volume are calculated using the formula (2) given below:

$$V_P = \frac{1}{V - \frac{W_2}{\rho_2}} \left[ V - \frac{W_1}{\rho_1} - \frac{W_2}{\rho_2} \right] \quad (2)$$

where

V: volume of container for producing matrix at the portion where matrix material was packed in practice (with the proviso that the value represented the portion up to the measured value of the level meter), $W_1$: weight of mortar of matrix material, $\rho_1$: density of mortar of matrix material, $W_2$: weight of wastes, $\rho_2$: density of wastes.

In this embodiment, when the quantity of cement reacted with the carbonic acid gas was calculated, it was found to be 100 l because the volume of the cement mortar inside the drum was about 50%. The void which was formed at the beginning when the cement mortar was poured was 20 l because it was about 20% of 100 l. This corresponded to about 1 mol of carbon dioxide under the standard state (0° C., 1 atm). From equation (1), it is one mol of calcium that reacted with about 1 mol of carbon dioxide, that is, about 40 g. Since the quantity of cement poured into one drum was assumed to be 100 l×2 kg/l=200 kg, the quantity of cement reacted with the carbon dioxide is below 0.1% and this value does not render any problem at all. Therefore, there is no adverse influence on the physical properties of the cement waste form.

This embodiment provides the effect that the solidified waste form of the miscellaneous solid wastes having less void can be obtained. It also provides the effects that the strength of the cement waste form after setting can be improved due to the reaction of the carbon dioxide with the cement and that solidification can be made without removing the polyethylene sheet.

Embodiment 2

Figure 5:
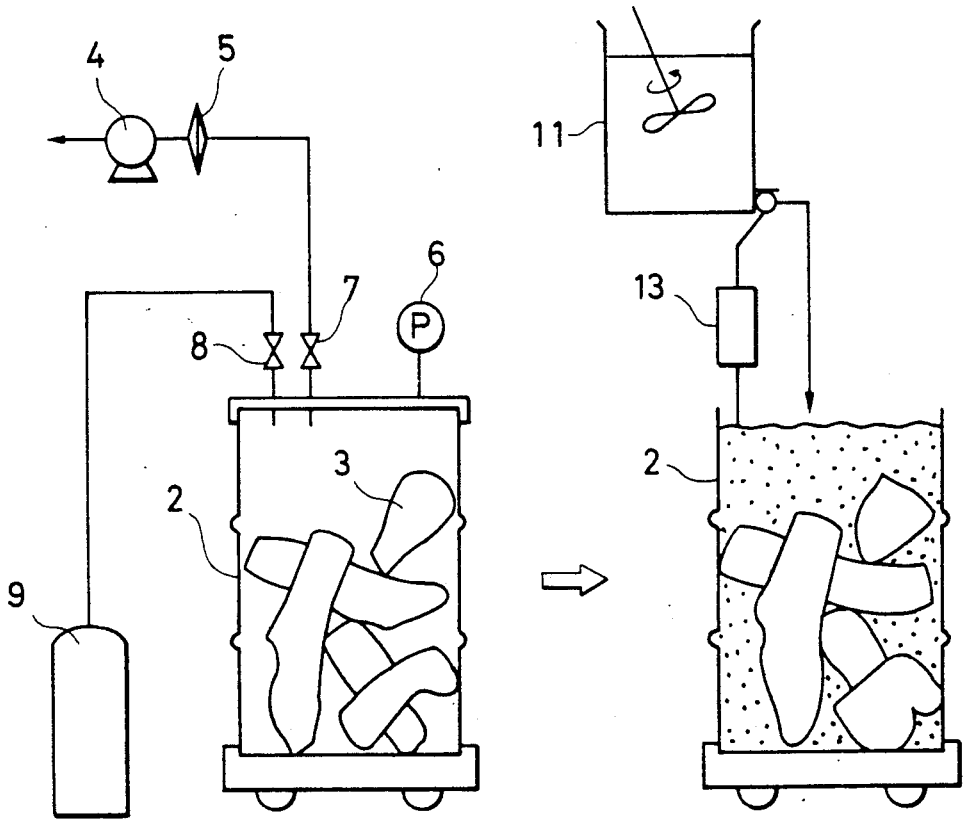
FIG. 5 is a conceptual view of the apparatus in accordance with another embodiment of the present invention.

This embodiment conducts solidification by use of the drum alone without using the pressure-resistant container. FIG. 5 is a conceptual view useful for explaining this embodiment. The non-combustible miscellaneous solid wastes 3 wrapped by the polyethylene sheet were put into the drum 2 having a 200 l capacity. A cover for the vacuum exhaust of the drum was put to the upper part of the drum 2. The air inside the drum was evacuated by the vacuum pump 4 and any radioactive substances in the exhaust air were removed by the HEPA filter 5. If the internal pressure of the drum was reduced too much, the trouble such as a dent of the drum would occur. Therefore, evacuation was stopped when the pressure gauge 6 read 0.3 kg/cm$^2$ in terms of absolute pressure and the valve 7 was closed. The valve 8 for the carbon dioxide was opened and the carbon dioxide gas was charged into the drum 2 from the carbon dioxide gas cylinder 9 till the pressure gauge 6 indicated an absolute pressure of 1 kg/cm$^2$. Vacuum exhaust and charging of the carbon dioxide into the drum were repeated thrice so that the carbon dioxide concentration reached at least 97% inside the drum. Next, the cover at the upper part of the drum was removed and the drum was moved towards the cement mixer 11. In the interim, since carbon dioxide has a greater specific gravity than air, there was hardly any possibility that the carbon dioxide in the drum was diffused outside. (Therefore, a gas having a great specific gravity was preferred as the substitution gas.) The cement pouring line from the cement mixer was set to the upper part of the drum and the cement mortar was poured into the drum 2. An about 20% of gas volume ratio to slurry volume existed initially after pouring of the cement mortar but the carbon dioxide in the void was absorbed and solidified in the cement in accordance with equation (1) described already. The cement flowed into the void due to the pressure reduction inside the void. There was thus obtained the matrix which hardly had any void.

This embodiment provides the effect that the solidified waste form having hardly any void can be obtained by a simple solidifying apparatus using the drum alone without using the pressure-resistant container.

Figure 6:
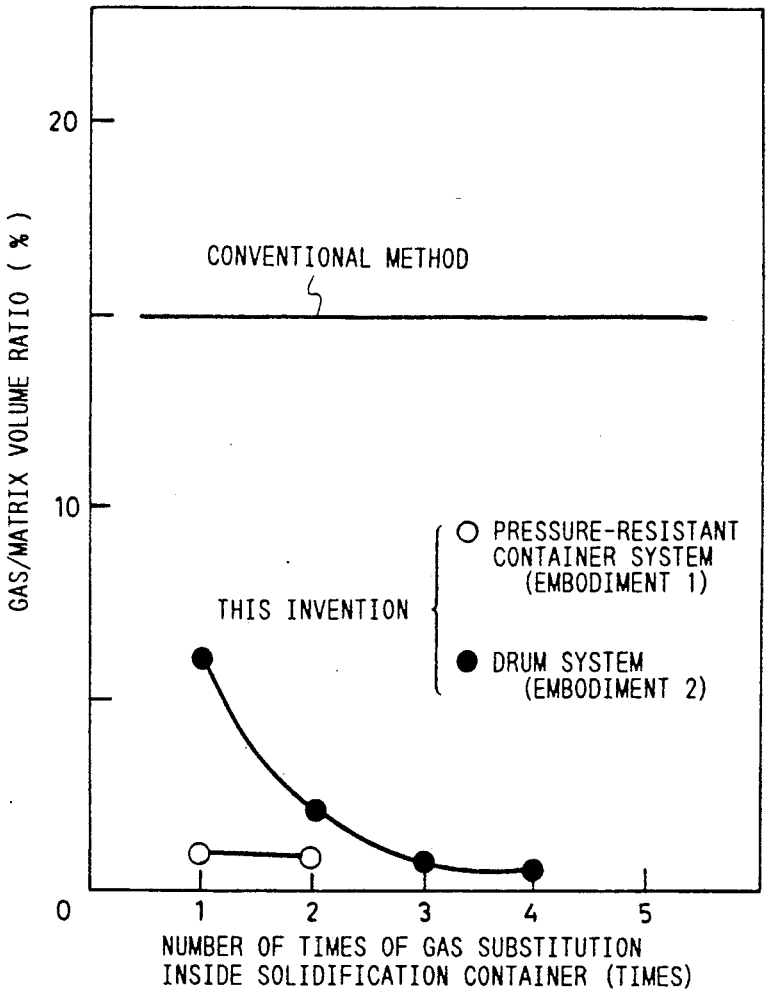
FIG. 6 is a diagram showing the relationships between the number of gas substitution inside a solidifying container and gas/matrix volume ratio.

FIG. 6 is a diagram showing the void volume ratios to the cement motar portion as the matrix material in Embodiments 1 and 2 of the present invention in comparison with a conventional method. The number of times of substitution of the gas in the drum as the container is only one in Embodiment 1 and it is at most 3 in Embodiment 2, and the void volume ratio to the matrix material could be reduced to approximately 1% in either case.

Embodiment 3

A mixture of cement with water glass and silicon-phosphate was used as the matrix material in place of the cement and the same apparatus as that of Embodiment 1, that is, the apparatus shown in FIG. 1, was used. As a result, miscellaneous solid wastes with hardly any voids could be obtained within about 15 minutes in the same way as in Embodiment 1. In this embodiment the sodium ions or atoms in the water glass were believed to react in accordance with the following formula (3):

$$2Na^{-}(\text{in water glass}) + 2OH^{-} + CO_2 \rightarrow Na_2CO_3 + H_2O \quad (3)$$

It was believed in this embodiment, too, that the reaction of the formula (3) proceeded in the voids occurring in the matrix material prepared by mixing the cement with water glass and silicon-phosphate, vacuum took place in the voids and this exhibited the action of filling the voids. It was assumed that the reason why the time of filling the voids by the matrix material prepared by mixing the cement with water glass and silicon-phosphate was short was that the sodium compound has higher water-solubility than the calcium compound.

This embodiment provides the effect that the operation time can be shortened because the void filling time is shorter.

Incidentally, when the cement containing sodium such as early high-strength cement was used or when sodium hydroxide was added to the cement, the same effect as that of the present embodiment could be observed.

Embodiment 4

Figure 7:
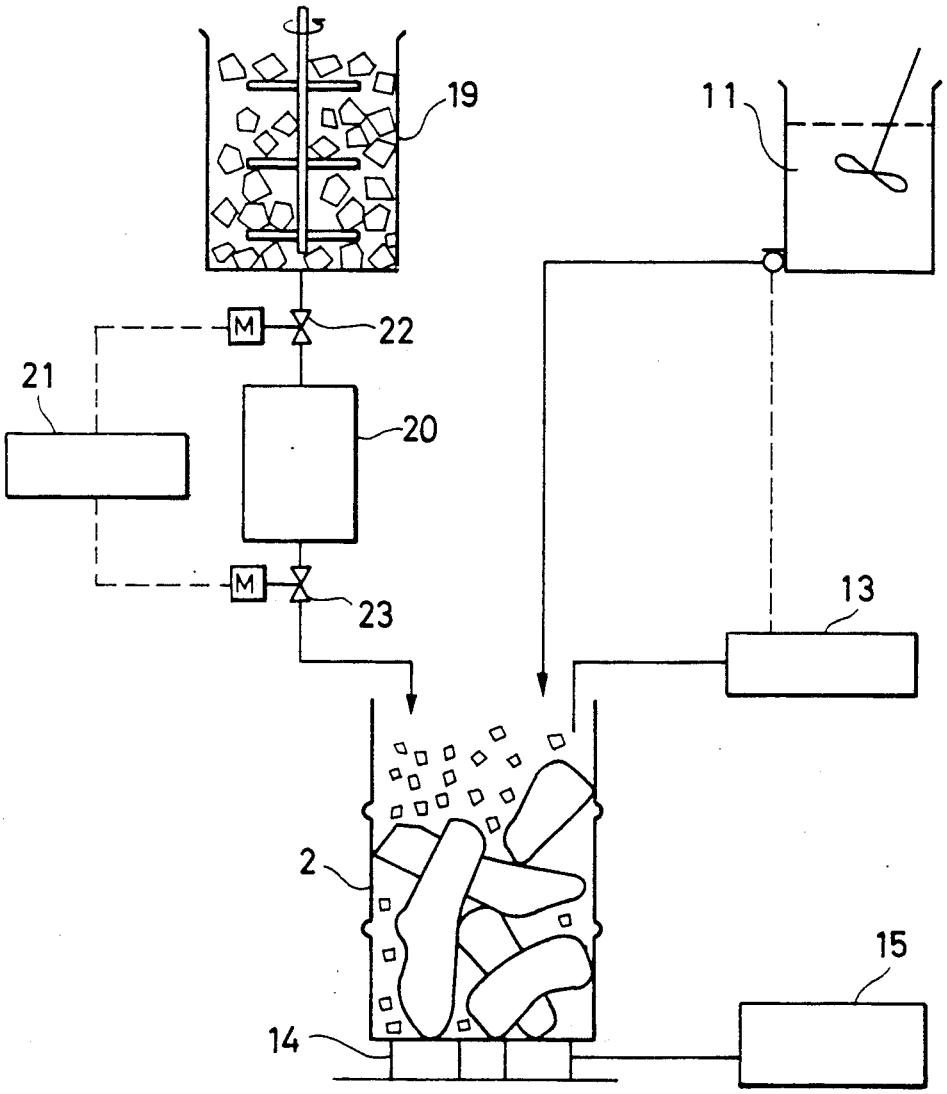
FIGS. 7, 8 and 9 are conceptual views showing the apparatus in accordance with other embodiments of the present invention. Best Mode for Carrying Out the Invention.

FIG. 7 is a conceptual view of an apparatus useful for explaining still another embodiment of the present invention. This embodiment was directed to effect cement solidification of the miscellaneous solid wastes by use of dry ice in place of the carbon dioxide. The dry ice in a dry ice pulverizer 19 was pulverized to a mean diameter of from 1 to 2 cm and charged into a quantitative feeder 20 of a load cell system. After about 400 g of dry ice was measured, it was supplied into the drum 2 by opening an electromagnetic valve 23. The air inside the drum was purged outward by the dry ice and the carbon dioxide generated by the dry ice. After the passage of about five minutes, the valve of the cement mixer 11 was opened and the cement mortar was poured into the drum. Since the cement mortar was at about 20° C., the dry ice changed to the carbon dioxide within a short period. The voids occurring in the matrix was filled in accordance with the aforementioned formula (1) in the same way as in Embodiments 1 and 2 and there could be obtained the matrix almost free from any voids.

Since the evacuation operation is not necessary, this Embodiment provides the effect that the operation becomes simplified and the quantity of secondary wastes can be reduced without using any filter.

Embodiment 5

This embodiment uses the carbon dioxide after passing it through a heat exchanger and heating it to about 60 to 90° C. When the carbon dioxide heated to about 60° C. or above was jetted into the drum, the polyethylene sheet wrapping the non-combustible miscellaneous solid wastes was heated to 60° C. and underwent thermal deformation so that the sheet came into close contact with the miscellaneous solid wastes. When the cement mortar was poured into the drum under this state, the cement mortar could flow more easily and since the temperature was high, the reaction rate became higher and the solidified waste form with less voids could be obtained in a shorter period.

Since the setting time is short, this embodiment provides the effect that the handling after the solidification becomes easier.

Though the foregoing Embodiments Nos. 1 to 5 represent the case where the gas which reacts with the alkaline inorganic matrix and is absrobed and immobilized therein is limited to the carbon dioxide, it is also effective to use the sulfurous acid gas ($SO_3$), the nitrogen oxide gas ($NO_x$) and the hydrogen sulfide gas ($H_2S$) besides the carbon dioxide.

Embodiment 6

Figure 8:
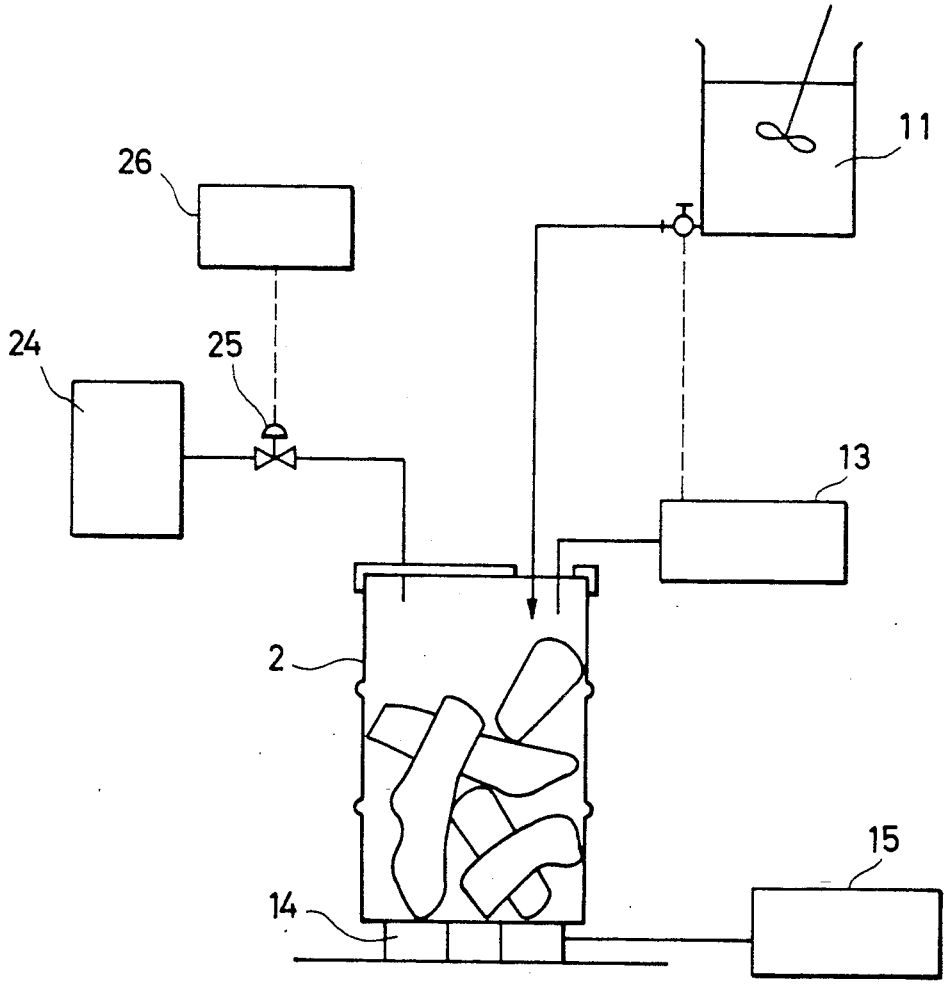

FIG. 8 is a conceptual view of an apparatus useful for explaining still another embodiment of the present invention. This embodiment used saturated steam in place of the carbon dioxide to utilize the condensation of steam and to reduce the voids in the cement as the matrix material. The steam from a steam generator 24 was adjusted by a valve 25 in accordance with a control system 26 and supplied into the drum 2. The air inside the drum was substituted by the steam after the passage of a predetermined period of time. The valve 25 was automatically closed by the control system 26 after the passage of a predetermined period. When the supply of the steam was stopped, the cement mortar at room temperature was poured from the cement mixer 11 into the drum 2. The pouring quantity of the cement mortar into the drum 2 was measured and controlled by the level meter 13. At the same time the void ratio to matrix was measured by the load cell 14 and the management system 15 for evaluating the waste form. The steam existing in the voids of the matrix was cooled and condensed by the cement, mortar the matrix material. The voids were filled by the cement due to the pressure reduction effect. There was thus obtained the matrix having void volume ratio of about 1%.

This embodiment provides the effect of cost-reduction because it uses the vapor in place of the active gas such as the carbon dioxide gas or the like.

Incidentally, ethanol and methanol as a water-soluble substance having a low boiling point provides the same effect as the steam when condensability of gas is utilized.

Embodiment 7

The wastes wrapped by the polyethylene sheet were put into the drum and the air was heated to 150° C. and jetted into the drum. The polyethylene sheet inside the drum was softened without decomposition and combustion and came into close contact with the wastes. Next, the cement mortar was poured. This pouring operation could be finished rapidly because the voids resulting from the polyethylene sheet were small. The limited voids occurring in the solidified waste form (15 to 20% in terms of the void/matrix volume ratio) decreased with the return of the air temperature in the voids from 150° C. to room temperature and there was thus obtained the matrix relatively free from the voids (up to 10% in terms of the void/matrix volume ratio).

This embodiment provides the effect that the solidified waste form of the wastes with less voids can be obtained by use of a simple apparatus and a simple operation within a short period. The same effect as that of this embodiment can be obtained by heating the periphery of the drum to about 150° C. by an electric furnace or the like, besides the method of jetting the heated air to the drum.

Though the foregoing embodiments (Embodiments Nos. 1-7) represent the case where the cement and the mixture of the cement with water glass and silicon-phosphate were used as the matrix materials, the same effect could be observed by use of other matrix materials e.g. other inorganic matrix materials such as water glass and gypsum, various Portland cements such as expansion cement, early high-strength cement, blast-furnace cement, silica cement, magnesia cement, high strength cement, and the mixture of the cement with various additives (dispersant, polymer emulsion, defoaming agent, retarder, silica fine powder, etc.).

Embodiment 8

Figure 9:
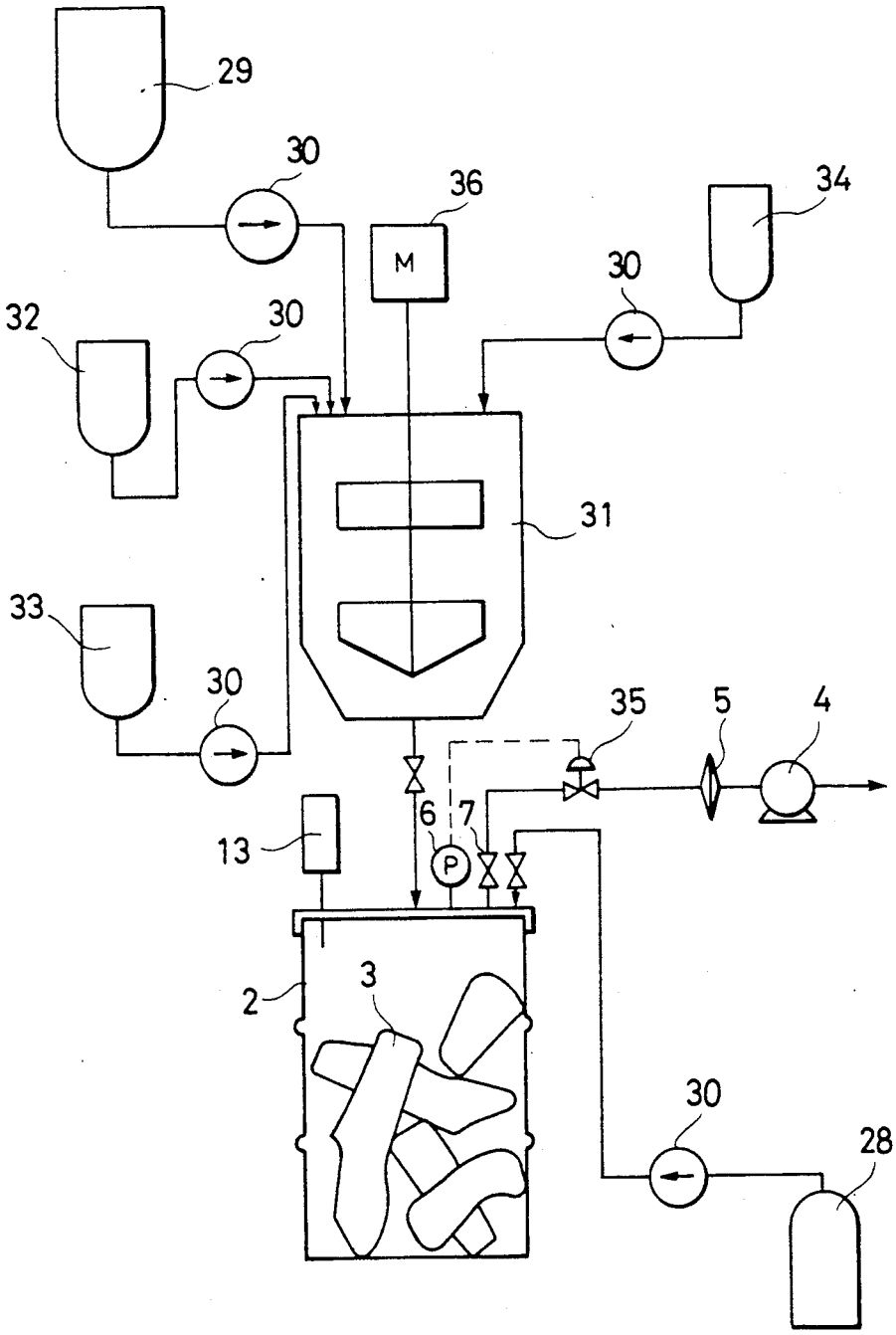

The present invention can be applied not only to inorganic matrix materials but also to organic matrix materials. Still another embodiment of the present invention in plastic solidification will be explained with reference to FIG. 9. This embodiment was directed to reduce the voids in the solidified waste form by filling in advance the solidifying container by the gas reacting with the polymer matrix material when the radioactive solid wastes were solidified by the polymer matrix material.

The non-combustible solid wastes 3 wrapped by the polyethylene sheet were placed in the drum 2. The air inside the drum 2 was evacuated by the vacuum pump 4 through the HEPA filter 5. The valve 7 was closed when the pressure gauge 6 read 0.3 kg/cm$^2$ by absolute pressure, and an ethylene gas was charged from an ethylene gas cylinder 28 till 1 kg/cm$^2$. On the other hand, an unsaturated polyester resin as the polymer matrix material was sent from a matrix material tank 29 into a mixing tank 31 through a metering pump 30. A polymerization initiator was sent from a polymerization initiator tank 32 to the mixing tank 31 so that the unsaturated polyester molecules and the styrene monomer were mixed and started the polymerization reaction. A polymerization promoter and a polymerization inhibitor were sent from a polymerization promotor tank 33 and a polymerization inhibitor tank 34 to the mixing tank, respectively, in accordance with the rate of the polymerization reaction in order to control the polymerization reaction. About 30 minutes later after mixing, the polymer matrix material was charged into the drum filled with the ethylene gas at the state where the polymerization reaction did not much proceed. The internal pressure of the drum rose due to the charging of the matrix material, but it was adjusted to 0.9-1 kg/cm$^2$ by an automatic pressure regulating valve 35. Since the matrix material was at about 80° C. due to the polymerization reaction heat, the polyethylene sheet wrapping the wastes underwent thermal deformation and the quantity of occurrence of the voids became relatively small. The voids occurred locally below the wastes and elsewhere, but since about 70% of the gas in the voids was ethylene, this ethylene and the unsaturated polyester in the matrix material reacted with each other. At the stage where the polymerization reaction was complete after about 24 hours, the polymer matrix was hardened and the voids were filled so that the waste form with hardly any voids could be obtained. This embodiment provides the effect that the solidified waste form of the wastes having less voids can be obtained by use of the polymer matrix material which is an organic matrix material.

This embodiment represents also that a solidified waste form with hardly any voids can be obtained by adding in advance to the container or substituting in advance its interior by styrene monomer, ethylene monomer, acetylene monomer, butadiene monomer, vinyl ester and other organic materials which have the action of reacting with, or absorbing or condensing, the polymer matrix material when the polymer solidified waste form is produced by use of the unsaturated polyester resin or the polyethylene resin. Styrene or divinyl benzene is effective as the material to be added or to be used for substitution when the polystyrene resin is used as the matrix material and a urea or formaldehyde resin is effective when a urea-formaldehyde resin is used. In the case of the epoxy resin, epoxy or phenol is effective. Though all the foregoing embodiments represent the case of the metallic wastes and concrete wastes as the wastes, the present invention is also effective for other miscellaneous solid wastes such as fabrics, sheets, rubber gloves, wooden materials, filter sludges, waste resins, pellets of powder and all other radioactive solid wastes as well as wastes from reprocessing plants and medical set-ups.

When the radioactive solidified waste form is produced by pouring matrix materials, the present invention provides the effect that the void matrix volume ratio can be reduced because it can reduce the pressure in the voids that develop in the solidified waste form.

We claim:

1. A method of solidifying radioactive wastes comprising:

substituting the atmosphere inside a container for producing a solidified waste form, packed with said radioactive solid wastes, with a condensable vapor; and then pouring a matrix material into said container for solidifying said radioactive solid wastes in said container and condensing said vapor.

2. A method of solidifying radioactive wastes according to claim 1, wherein said condensable vapor is steam.

3. A method of solidifying radioactive wastes according to claim 2, wherein said matrix material is an alkaline inorganic matrix material.

* * * * *